United States Patent [19]

Lenk

[11] Patent Number: 4,917,319

[45] Date of Patent: Apr. 17, 1990

[54] METHOD OF WINDING YARN PACKAGES

[75] Inventor: Erich Lenk, Remscheid, Fed. Rep. of Germany

[73] Assignee: Barmag AG, Remscheid, Fed. Rep. of Germany

[21] Appl. No.: 374,963

[22] Filed: Jun. 30, 1989

[30] Foreign Application Priority Data

| | | | |
|---|---|---|---|
| Jul. 6, 1988 | [DE] | Fed. Rep. of Germany | 3822862 |
| Jul. 14, 1988 | [DE] | Fed. Rep. of Germany | 3823774 |
| Feb. 21, 1989 | [DE] | Fed. Rep. of Germany | 3905205 |

[51] Int. Cl.[4] ..... B65H 67/048

[52] U.S. Cl. ..... 242/18 A

[58] Field of Search ..... 242/18 A, 18 PW, 25 A

[56] References Cited

U.S. PATENT DOCUMENTS

| | | | |
|---|---|---|---|
| 3,921,923 | 11/1975 | Kuno et al. | 242/18 A |
| 4,002,307 | 1/1977 | Turk et al. | 242/18 A |
| 4,033,519 | 7/1977 | Abe et al. | 242/18 A |
| 4,216,920 | 8/1980 | Tambara et al. | 242/18 A |
| 4,431,138 | 2/1984 | Schiminski et al. | 242/18 A |
| 4,487,374 | 12/1984 | Sugioka et al. | 242/18 A |
| 4,504,021 | 3/1985 | Schippers et al. | 242/18.1 |
| 4,504,024 | 3/1985 | Gerhartz | 242/18.1 |
| 4,789,112 | 12/1988 | Schippers et al. | 242/178 |
| 4,798,347 | 1/1989 | Schippers et al. | 242/18 R |

FOREIGN PATENT DOCUMENTS

| | | |
|---|---|---|
| 0256411 | 8/1987 | European Pat. Off. . |
| 3627081 | 2/1988 | Fed. Rep. of Germany . |
| 3627879 | 2/1988 | Fed. Rep. of Germany . |
| 3723524 | 2/1988 | Fed. Rep. of Germany . |

*Primary Examiner*—Stanley N. Gilreath

*Attorney, Agent, or Firm*—Bell, Seltzer, Park & Gibson

[57] ABSTRACT

A yarn winding method is disclosed which involves a package doffing sequence for automatically transferring the running yarn to bobbins which are serially delivered to a winding position, and which reduces the tendency of the yarn to form laps on the equipment during the yarn transfer. The method includes the steps of winding the running yarn onto a first bobbin while traversing the yarn to form a cross wound package, laterally withdrawing the bobbin from its winding position when it becomes full, bringing an empty rotating second bobbin into circumferential contact with the running yarn, and then terminating the traverse of the yarn and transferring the yarn to the empty bobbin. Also, the traversing speed is decreased at the beginning of the doffing sequency and shortly prior to the traverse being terminated, and so that the tendency of the running yarn to slacken and form laps during the transfer operation is reduced.

14 Claims, 6 Drawing Sheets

METHOD OF WINDING YARN PACKAGES

BACKGROUND OF THE INVENTION

The present invention relates to a method of winding a high speed running yarn onto bobbins serially presented to a winding position, and without yarn stoppage or loss of yarn between bobbin changes. The method is particularly applicable to the production of man-made fibers produced in a spinning installation.

U.S. Pat. No. 4,431,138 discloses a method and apparatus for serially winding a high speed running yarn onto bobbins and wherein two bobbin receiving spindles are mounted on a rotatable turret which is adapted to serially deliver the bobbins to the winding position. When the first bobbin becomes full, the turret is rotated to move the full bobbin laterally away from the yarn traverse guide, and the spindle with an empty bobbin and an associated yarn catching notch is moved into the yarn path of travel while being rotated, and with the notch being positioned axially outside the yarn traverse stroke. The separated full bobbin, which continues to receive the yarn, is then moved axially so that an end portion is aligned with the plane of the yarn catching notch on the empty bobbin. An auxiliary yarn guide is then moved to engage the yarn and terminate its traverse, and the guide then moves the yarn into the plane of the yarn catching notch, and so that the yarn is initially wound on the axially extended end portion of the full bobbin until the notch catches the Yarn, at which point the yarn breaks and commences to be wound upon the rotating empty bobbin. The auxiliary yarn guide then releases the yarn so that it is caught and again traversed by the traverse guide. Similar doffing methods are disclosed in DE-PS No. 24 61 223, and in PCT application No. DE 89-00094.

In the above described yarn winding methods, the empty bobbin carries a yarn catching notch or groove which is arranged in one normal plane of the bobbin. For catching the yarn in the groove or notch, the yarn has to be guided in this normal plane. It is, therefore, necessary to stop traversing of the yarn and to lead the yarn into the normal plane. As a result, the yarn length between the rotating empty bobbin and the preceding delivery system develops slack, which often leads to the formation of a lap of the yarn on the delivery system.

In the above described winding methods, the yarn tension between the rotating empty bobbin and the preceding delivery system is further decreased, when the yarn is caught in the groove of the empty bobbin, since the empty bobbin is rotated in a direction, so that its surface travels opposite to the direction of the yarn movement. However, the above problem of lap formation due to yarn slackening during the yarn transfer operation is also found in other types of yarn winding apparatus, in which the turret is rotated in such a way that the empty bobbin is rotated in a direction so that its surface travels in the direction of the yarn movement.

It is accordingly an object of the present invention to provide a method of serially winding yarn packages, and wherein the tendency of the yarn to slacken during the yarn transfer operation is eliminated or at least reduced, to thereby reduce the risk of a breakdown in the operation by reason of a lap formation on the delivery system.

SUMMARY OF THE PRESENT INVENTION

The above an other objects and advantages of the present invention are achieved in the embodiments illustrated herein by the provision of a winding method which comprises the steps of winding the running yarn onto a rotating first bobbin positioned at a winding position while gradually reducing the rotational speed of the bobbin, and traversing the yarn at a location upstream of the winding position to thereby form a cross-wound package on the first bobbin. Upon the bobbin becoming full, the rotating first bobbin is laterally separated from the winding position, and such that the length of the running yarn between the traversing location and the full bobbin increases, and while continuing to wind the yarn onto the rotating full bobbin. An empty rotating second bobbin is then brought into circumferential contact with the yarn running from the traversing location to the laterally separated full bobbin, and the traverse of the running yarn is terminated and the running yarn is then transferred from the rotating full bobbin to the rotating second bobbin. The method of the present invention also includes the step of decreasing the traversing speed during a period beginning shortly prior to the traverse being terminated, and with the rate of change of the decreasing traverse speed being greater than the rate of change of the decreasing rotational speed of the bobbin at the end portion of the operative winding step.

In the preferred embodiment, the step of decreasing the traversing speed occurs during and begins substantially concurrently with the step of laterally separating the rotating first bobbin from the winding position.

In accordance with the present invention, the sudden decrease in the yarn tension which normally occurs when the yarn is stopped being traversed and when the yarn is caught, is considerably reduced. Although the entire decrease of the winding speed from the normal operation to the catching of the yarn is uniform, it has been found that a sudden drop of the yarn tension and the magnitude of this drop are primarily responsible for the above described breakdowns in the winding process.

The traversing speed is reduced steadily or, if need be, in small steps, within a short period of time in relation to the total winding cycle of a full package, preferably resulting in a winding layer thickness of no more than 1 mm.

In one embodiment of the invention, the slackening of the yarn is kept at a minimum between the normal operation and the catching of the yarn, by increasing the circumferential speed as the traversing speed is decreased. The circumferential speed may be increased to an extent such that the yarn winding speed is unchanged from its nominal operational value, or alternatively, the circumferential speed may be increased to an extent such that the yarn winding speed increases slightly from its nominal value. In this latter embodiment, the yarn tension, which is initially increased, is decreased below its nominal value when the traversing motion discontinues. The short-time increase of the yarn tension, which occurs according to this embodiment, is not unfavorable from the viewpoint of the winding technology, since it results in a few firmly wound layers of yarn being deposited on the full package, which increases the stability of the full package.

In a further embodiment, the circumferential speed is increased so as to equal the nominal value of the yarn winding speed. This results in the yarn tension not dropping below its nominal value.

As noted above, it has been found that a sudden slackening of the yarn may be solely responsible for a breakdown of the winding process. Consequently, a jump, by which the yarn tension decreases at the moment the yarn is caught, should not become too great. For this objective, it has been found that the yarn winding speed should decrease by no more than 0.5%, and preferably less than 0.2%.

The method of doffing a package according to the present invention fits in a favorable manner in the entire winding process. On the one hand, final yarn layers are formed, which have only a small crossing angle and, consequently, do not tend to slip axially inwardly. The crossing angle (i.e. the angle between the tangent to the bobbin and the yarn) after decrease of the traverse speed as per this invention is preferably equal or less than three degrees. On the other hand, these yarn layers are wound very firmly, so that they form a surface layer for the further inwardly located yarn layers. Moreover, the traversing speed, which is reduced according to the present invention, is also suitable in a special manner for winding the initial layers on a new package.

The method of package doffing according to the present invention may be integrated in the winding method for the formation of a new package. Specifically, after the yarn is caught on the rotating empty bobbin, the traversing motion may be restored substantially to the speed at which it was terminated. The speed may then be subsequently increased steadily or in small steps to the nominal traversing speed necessary to produce a cross wound package, and preferably before 10% of the entire layer thickness of the package is produced. As a result of this method, a basic layer is formed when winding a new package, which layer has a slightly greater width than the remaining wound layers and possesses slightly conical side edges, thereby imparting a better support to the remainder of the package. Details of this winding method may be obtained from U.S. Pat. No. 4,789,112 as well as U.S. Pat. No. 4,798,347.

As is already known from U.S. Pat. No. 4,002,307, an increase of the spacing of the full package from the traversing system results in a decrease of the displacement length at which the yarn is deposited on the full package. This effect may be combined with the sharp decrease of the traversing speed in such a manner that the yarn still advancing to the full package cannot laterally drop from the full package. This procedure may advantageously be combined with the first phase of the package doffing operation, when the method is applied to winding machines in which two spindles are alternately in operation and on standby.

The decrease of the spacing between the yarn traversing system and the new package to be formed, which occurs after a package is doffed, should occur when the traversing motion restarts, however, before the traversing speed is again increased from its reduced value. This allows to further increase the formation of a widened basic layer, as is desired according to the aforesaid European applications.

BRIEF DESCRIPTION OF THE DRAWINGS

Some of the objects and advantages of the present invention having been stated, others will appear as the description proceeds, when taken in conjunction with the accompanying somewhat schematic drawings, in which.

DETAILED DESCRIPTION OF THE PREFERRED EMBODIMENTS

Figure 1:
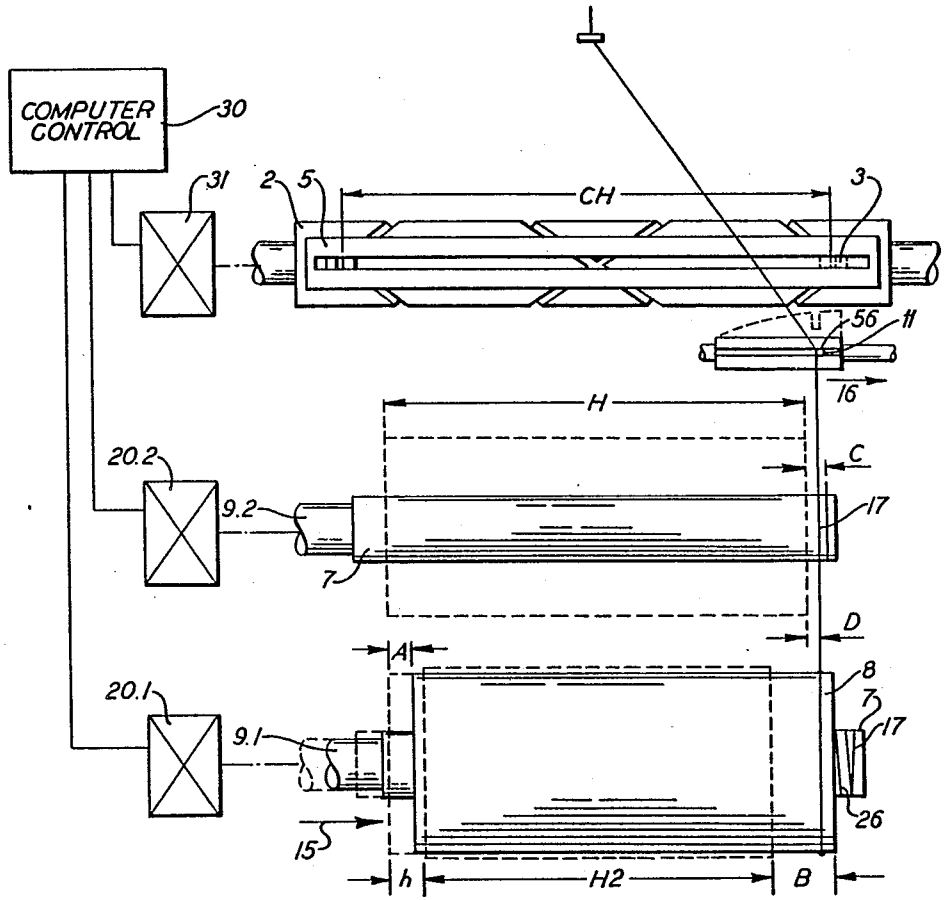
FIG. 1 is a schematic side elevation view of a yarn winding apparatus adapted to operate in accordance with the method of the present invention.
Figure 1A:
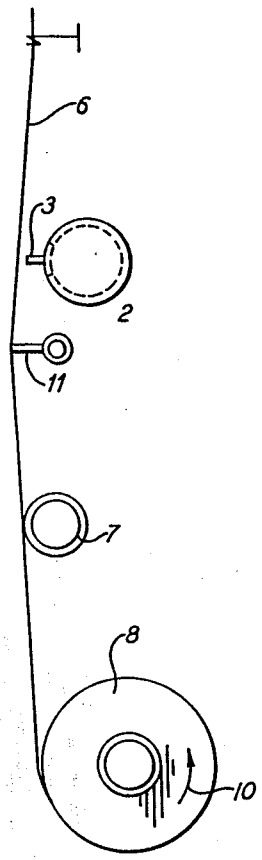
FIG. 1A is a front elevation view of the apparatus shown in FIG. 1.

Referring more particularly to the drawings, FIGS. 1 and 1A illustrate a preferred embodiment of a yarn winding apparatus in accordance with the present invention, and which comprises a yarn traversing system 1 with a cross-spiralled roll 2 and a traversing yarn guide 3. The traversing yarn guide 3 reciprocates in the grooves 4 of the cross-spiralled roll and is guided in a straight line in a guideway 5. The traversing yarn guide 3 traverses a yarn 6 on a tubular bobbin 7 so as to form a cross-wound package 8. The bobbin 7 is firmly clamped on a winding spindle 9.1, and the winding spindle 9.1 is driven in a rotational direction 10 by a spindle motor 20.1. During the winding operation, a second winding spindle 9.2 with a bobbin 7 clamped thereon is on standby. Likewise on standby is an auxiliary yarn guide 11, which is further described below. The winding spindle 9.2 can be driven by a motor 20.2. A motor 31 serves to drive the yarn traversing system. The motors 31; 20.1; 20.2 can be started, stopped and varied in their speed independently of each other by a programmable control means 30.

During normal operation of the winder, the rotational speed of the spindle decreases, since the yarn speed remains constant, while the diameter of the bobbin increases. The traverse speed, however, is essentially constant (random winding) or is altered within a certain narrow range having an upper and a lower limit (step precision winding).

The packages may also be driven by a guide roll, which is not shown in FIGS. 1 and A. In such an event, the guide roll contacts the package surface and is driven at a constant speed.

Figure 2:
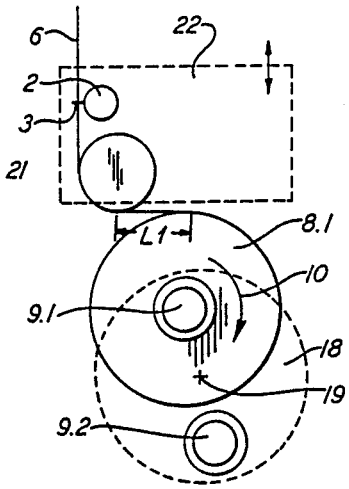
FIGS. 2–6 are schematic front views of the package doffing sequence of a winding apparatus in accordance with the present invention.

In the embodiment of FIGS. 2–6, a turret 18 is provided which is rotatable about an axis 19, and which accommodates the winding spindles 9.1 and 9.2 which are freely rotatable and project therefrom in cantilever fashion. The yarn traversing system also includes a guide roll 21, which is partially looped by the yarn 6, and which either rests against the package or forms with the package a very small gap, so that the trailing length L1 of the yarn is very short between the guide roll and the package. The yarn traversing system is mounted on a carriage 22, which is illustrated in FIG. 2 and movable in a vertical direction. Further details of the illustrated yarn traversing system may be obtained, for example, from U.S. Pat. Nos. 3,797,767 and 3,861,607. However, these are examples only and other traverse devices may be used such as, for example, shown in U.S. Pat. No. 4,505,436.

After or shortly before a winding operation is completed, i.e., when the package 8.1 at the winding position is almost full, the axial distance between the guide roll 21 and the fill bobbin is increased, so that the guide roll 21 completely releases the package 8.1. This is accomplished in the example which is shown by the carriage 22 moving first upwardly in a direction 23 and, as sown in FIG. 4, by the turret 18 being rotated in direction 24, until the winding spindle 9.2 with an empty bobbin 7.2 placed thereon enters into the yarn path. As a result thereof, the trailing length L2 is considerably increased between the point from which the yarn leaves the grooved roll, and the point at which the yarn contacts the full package 8.1, and the displacement stroke is correspondingly decreased. Concurrently therewith, the winding spindle 9.2 with empty bobbin 7.2 clamped thereon moves in direction of arrow 24 into the plane of the yarn path to the final or winding position shown in FIG. 5. In this regard, it will be noted that the empty bobbin is being rotated in a direction such that the surface movement on the side thereof adjacent the yarn path of travel opposes the direction of yarn movement.

As a result of the increase of the trailing length from L1 to L2, the displacement stroke H which is defined by the traversing stroke CH of yarn guide 3, is reduced, i.e., the winding length is decreased relative to the displacement stroke H2. This reduced displacement stroke H2 makes it possible to axially shift the winding spindle 9.1 in direction 15 by an amount A, without the yarn which is still in the traversing system dropping from the surface of the package. A is smaller than $h=H-H2/2$. It should be emphasized for completeness sake that the winding spindle 9.2 with the empty bobbin 7.2 remains in its original position when the yarn is changed, i.e., it is not axially displaced. Now the winding spindle 9.1 is axially moved in direction 15 in such a manner that, for example, the left front end surface of the full package 8.1 approximately coincides with the left end of the shortened displacement stroke.

The axial displacement of the winding spindle 9.1 results in a spacing B between the right front end surface of the full package 8 and the right front end surface of the new displacement stroke H2, with B being greater than h, but smaller than 2h.

At this time, the auxiliary yarn guide 11 is moved from its position shown in dashed lines in FIG. 1 into the plane of the yarn path 6. As a result, the yarn is lifted out of the traversing yarn guide 3 and caught in a yarn guide slot 56. The auxiliary yarn guide is then moved in the direction of arrow 16, as is shown in FIG. 1, and the yarn is moved out of the range of the traversing stroke CH, slightly beyond a yarn slot 17 provided in each bobbin 7.2, however, not beyond the normal plane of the right front end surface of the full package 8 in its axially displaced position. The length of movement C of auxiliary yarn guide 11 beyond the right edge of the normal displacement stroke H, which is shown in dashed lines on the chuck 9.2, is accordingly greater than, or at the most equal to, the distance which the yarn slot 17 is from the right edge of the normal displacement stroke H. However, the length of movement C is smaller than the amount A, by which the winding spindle 9.1 is axially displaced. Thus, as shown in FIG. 1, it is ensured that the yarn can be moved in the normal plane of the yarn slot, and in so doing, however, will not drop from the circumference of the full package 8, and it will continue to be wound on the full package and be advanced thereby even while it is being caught.

The yarn catching means for textile yarns is preferably arranged as a slot on the circumference of the bobbin 7.2 and located somewhat outside of the winding range H. In the range of the normal plane, in which this slot is located, the auxiliary yarn guide 11 performs a very slow axial movement in and through said normal plane, so as to ensure that the yarn is caught. Then, the auxiliary yarn guide is returned at a high speed to the range of the normal traversing stroke, so that, as results from FIG. 1, only few windings of a yarn transfer tail 26 are wound between the yarn slot 17 and the right end side of the normal winding range H. As soon as the auxiliary yarn guide 11 reaches the traversing range CH, it will be returned to its initial position, so that the yarn is again caught by the traversing devices and displaced so as to form a new cross-wound package. Now, the winding spindle 9.2 or respectively the empty bobbin placed thereon as well as the carriage 22 are moved back to their initial position in that the turret 18 is further rotated. The operating or winding position of the winding spindle 9.2 is shown in FIG. 6.

Figure 6:
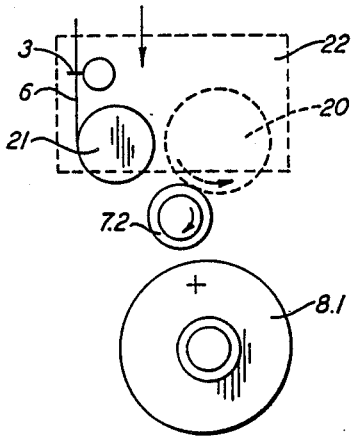

As also seen in FIG. 6, the carriage 22 has been again lowered. Deviating from the foregoing Figures, it is here shown that the drive during the winding may also be effected by a drive roll 20, which is driven at a constant circumferential speed and mounted on the carriage 22. In this embodiment, the drive motors 20.1, 20.2 are inoperative during the normal winding operation.

Illustrated in FIGS. 7–9 and 7A–9A are speed diagrams of the package doff. The operating sequences as suggested by the present invention are described below with reference to these speed diagrams. In the speed diagrams, VU indicates the circumferential speed of the package. During the winding of manmade fibers, for example, circumferential speeds of 5,000 m/min are possible.

VUW is the circumferential speed during the package doff.

VC is the traversing speed. During the winding of manmade fibers at a circumferential speed of the package of 5,000 m/min., the traversing speed is 700 m/min. for producing a crossing angle of 8°. For example, it should be noted that for purposes of avoiding or eliminating pattern formations the traversing speed normally does not remain constant during a winding cycle, but is varied according certain programs about an average value or within predetermined ranges. These variations have no consequence within the scope of the present invention and are disregarded in the present description. Within the scope of the present invention, the traversing speed is defined as the average traversing speed.

VCW is the traversing speed during a package doff.

VF is the yarn winding speed. The yarn winding speed is the geometric sum of the circumferential and traversing speeds. A circumferential speed of 5,000 m/min. and a traversing speed 700 m/min. result in a yarn winding speed of 5,050 m/min. From this, it will be seen that the yarn winding speed decreases by almost 1% when the traversing motion is discontinued.

The yarn winding speed VF is the speed by which the yarn is wound onto the package. This speed is related to the speed by which the yarn is delivered to the winder by the preceding delivery system. The delivery system, delivery rolls for example, which deliver the yarn at a constant speed are, for example, conventional godets and are not shown in FIGS. 1 to 5.

There is a certain difference between the delivery speed of the delivery system and the yarn winding speed VF. This difference is chosen such that the yarn is wound with a certain yarn tension on the package. The difference is not identical with the value DV as discussed below.

DV is the difference of the yarn winding speed between the nominal value of the yarn winding speed VF and the winding speed during the doffing phase.

If DV becomes greater than the previously discussed difference between the delivery speed and the actual yarn winding speed, the yarn tension will become zero and the yarn will slacken, and there is the danger of wrappers or laps occurring on the preceding delivery system or on the winder.

Alpha represents the Crossing angle (i.e. the angle between the yarn wound on the package and a tangent to the package intersecting the yarn).

Alpha W represents the crossing angle during the doffing phase.

As to the diagrams it should be noted that the speeds and times plotted therein are not to scale.

Figure 7:
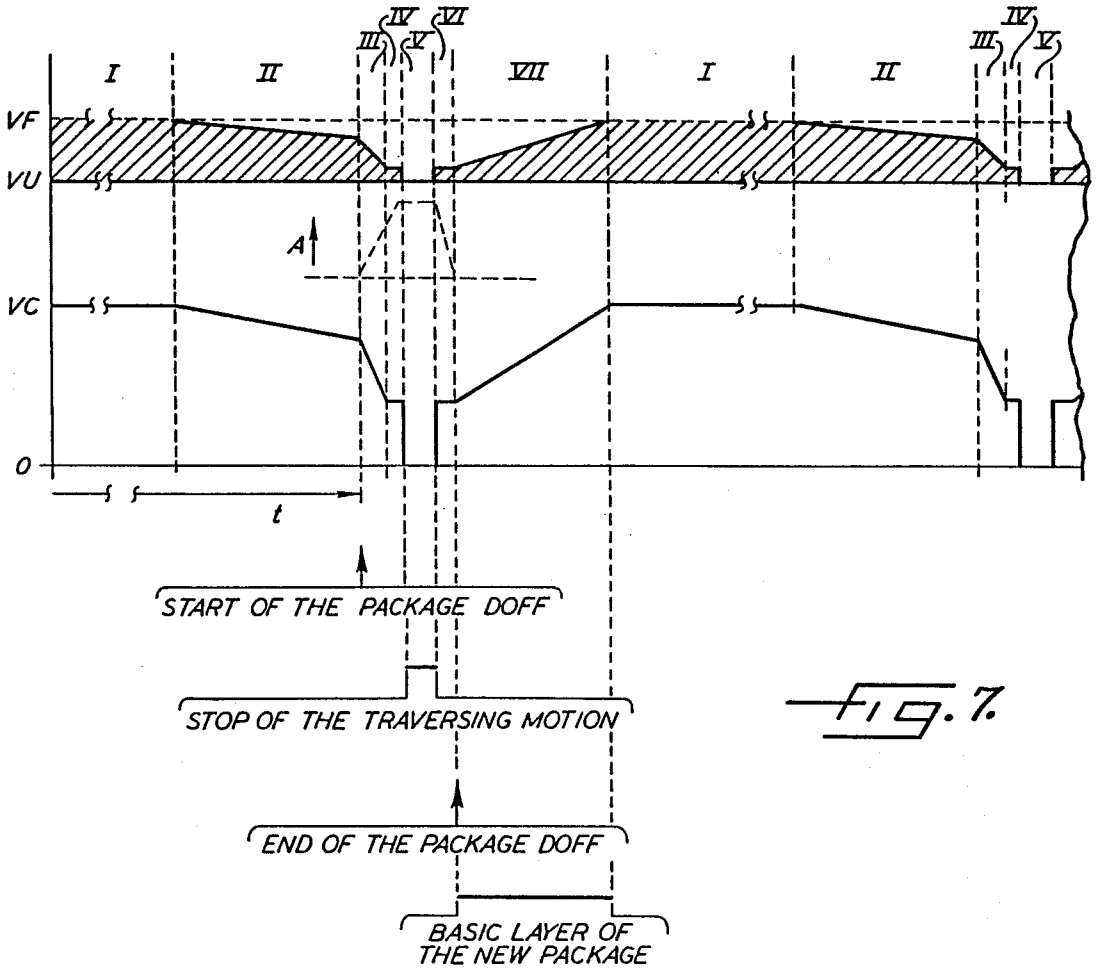
FIGS. 7–9 and 7A–9A are speed diagrams of the package doffing sequences in accordance with the present invention.
Figure 8A:
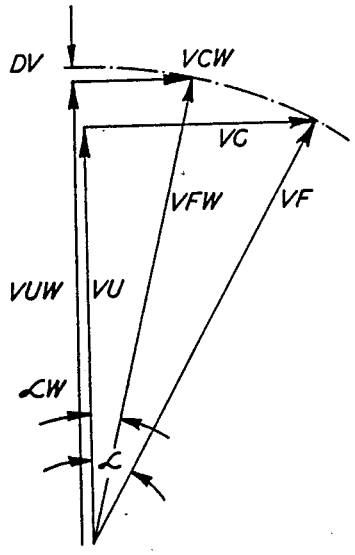
Figure 9A:
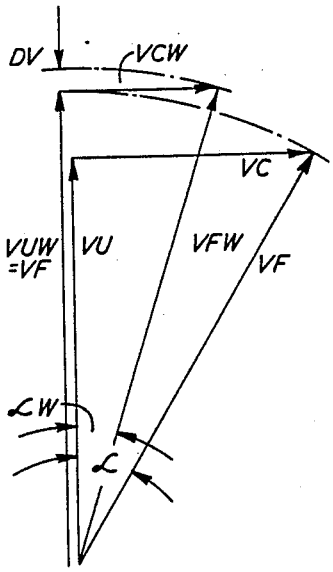
Figure 8:
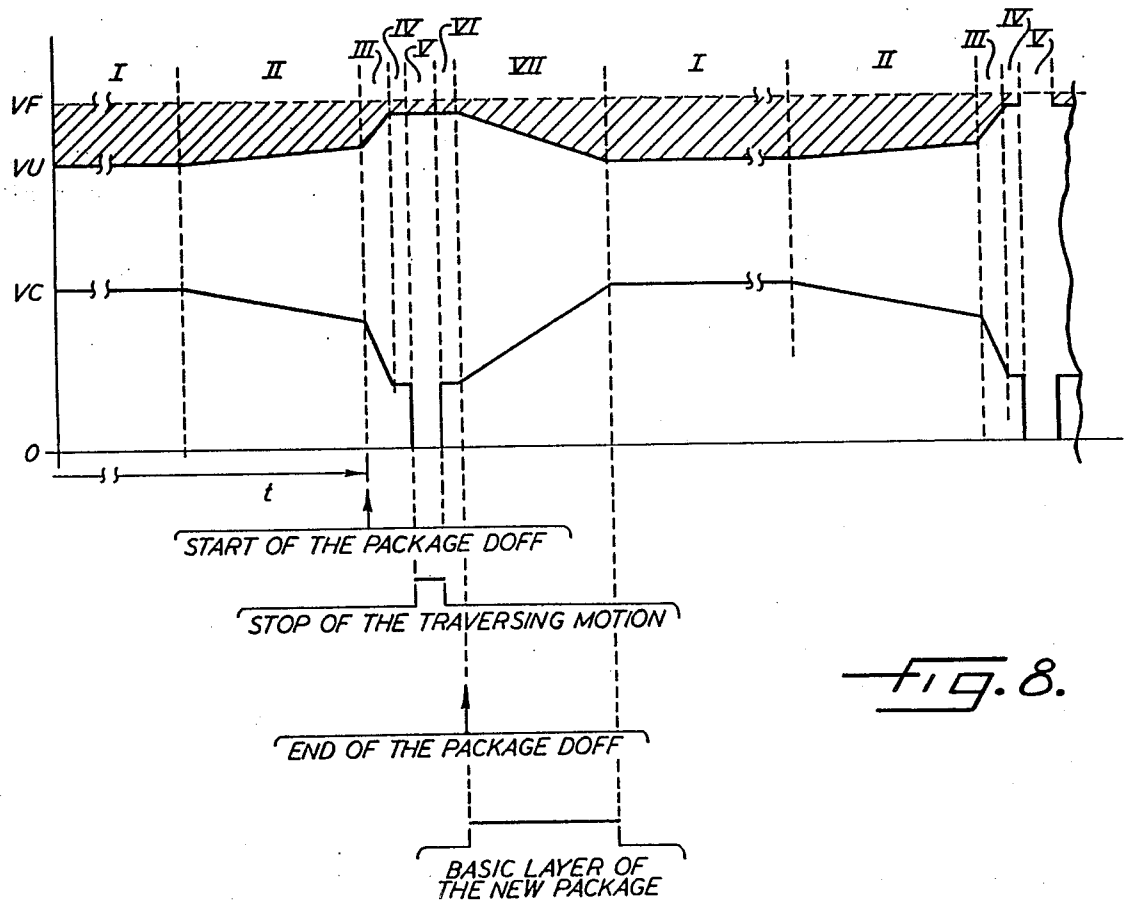
Figure 9:
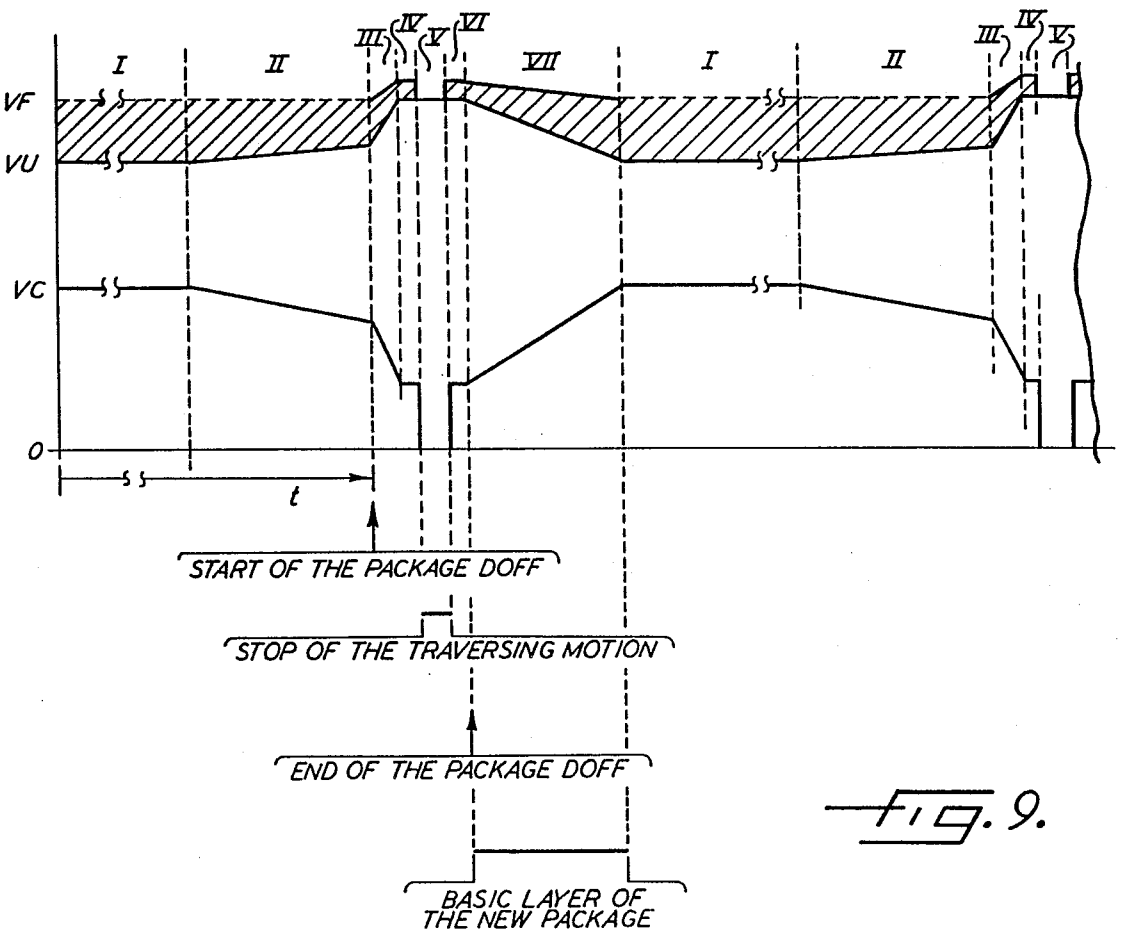

FIGS. 7–9 illustrate several embodiments of a method of doffing a package, in which the traversing speed VC is considerably reduced before the traversing motion stops, and in accordance with the present invention. In the operating phase I, in which the package is wound under its nominal conditions, the mean value of the traversing speed is constant. Consequently, the circumferential and traversing speeds add to the constant value of the yarn speed VF. Also, since the circumferential speed is constant, the rotational speed of the spindle necessarily gradually decreases as the package builds.

At the end of the winding cycle of phase I, the traversing speed may be reduced slightly (about 10 to 20%) and steadily in a phase II. This results in a change of the crossing angle. This reduction is known per se and is thus not a part of the present invention. Consequently, the phase II is not a part of the package doff, but a part of a normal winding cycle. It is, furthermore, known by U.S. Pat. Nos. 4,504,021 and 4,504,024 to build up a random winding and to decrease the traverse speed at the end of the build-up in proportion to the decreasing rate of rotation of the spindle. Therefore, at the end of the winding, a precision winding is produced. Also here, the decrease of the traverse speed is very low and is less than 10 to 20% depending on the diameter of the package and the denier of the yarn.

The relatively slight decrease of the traversing speed in phase II, as discussed above, does not call for measures to influence the length at which the yarn is deposited on the package. Although it is known that a decrease of the traversing speed results in an increase of the displacement length H of the yarn on the package, such an increase is, however, so small that the reduction of the traversing speed in phase II is inconsequential.

In phase III, the package doff is initiated and the traversing speed is reduced steadily to a fraction of its nominal value, i.e., the value which the traversing speed has at the end of the winding cycle. As a specific example, the traversing speed may be reduced by more than half of its nominal value. Also, the rate of change of the decreasing traverse speed is greater than the rate of change of the decreasing rotational speed of the bobbin during the end portion of phase II.

Figure 3:
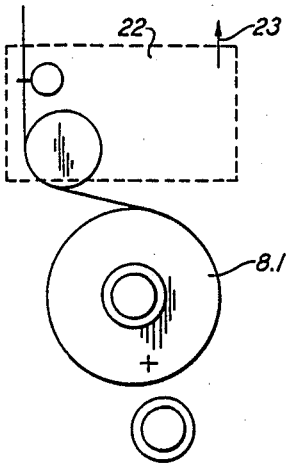
Figure 4:
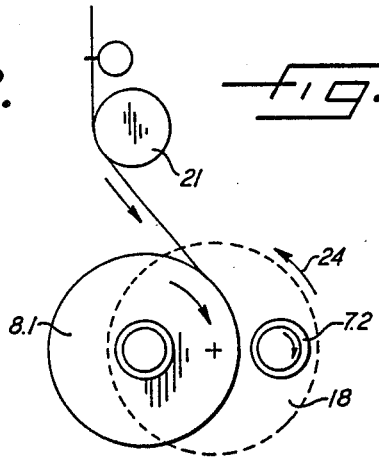
Figure 5:
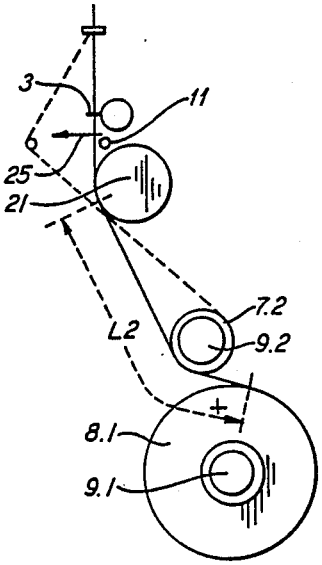

As is shown in FIG. 3, phase III is initiated in that the carriage 22 first moves upwardly, thereby creating an adequate spacing between the guide roll 21 and the full package 8.1. The traversing speed then starts to decrease considerably, and the turret 18 rotates at the same time, so that the spacing between the guide roll 21 and the full package 8.1 becomes greater and greater (FIGS. 4, 5). This also results in an increase of the trailing length between the guide roll 21 and the full package and thus in a tendency to decrease the displacement length of the yarn on the package. This decrease in the displacement length compensates for the increase of the displacement length which occurs by reason of the traversing speed being reduced, and is sufficiently great that the shortening of the stroke 2h occurs as was explained with reference to FIG. 1.

Subsequently, in a phase IV, the considerably reduced traversing speed may be maintained for a certain, short period of time. In a following phase V, the traversing speed is entirely discontinued. However, it is also possible to immediately stop the traversing motion without interposing the phase IV, when a considerably reduced value of the traversing speed is reached. As noted above, the traversing motion is discontinued in that after the movement of the auxiliary yarn guide 11 in the portion of the package doff illustrated in FIG. 5, the yarn is lifted out of traversing yarn guide 3 and placed on the empty bobbin 7.2 on winding spindle 9.2 by an axial movement of the auxiliary yarn guide, as explained above with reference to FIG. 1.

After the yarn is caught, a new package will be formed. To this end, the traversing speed is restored in phase VI to its last value. It should be noted that it is also possible to restore the traversing speed to a different value. When the traversing speed restarts at a reduced value, a phase VII follows, in which a basic layer of preferably no more than 10% of the entire layer thickness of the package is wound, and in which the traversing speed steadily increases to its nominal value. Now, phase I of the winding cycle follows, in which the traversing speed is left at its preselected, maximum value and is, on the average, kept constant. Then, the operating phases II, III, IV, V and VI follow again.

The above sequence of the traversing speed is also selected for the embodiments of FIGS. 8 and 9. In these embodiments, it should be noted that the phases IV and VI, in which the traversing speed is left at its considerably reduced value, may be omitted. In such event, the traversing speed remains until the end of the winding cycle at the value which it has in phase I. Further, it is also possible to restore the traversing speed after a package doff, i.e., phase V, at any value between the value of operating phase I and the lowest value of operating phase III.

Figure 7A:
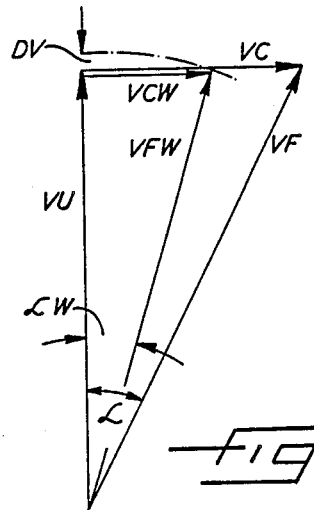

Illustrated in FIGS. 7 and 7A is a method, in which the circumferential speed of the package remains constant during the doffing phase. If the circumferential speed remains constant in the described operating sequence of the traversing speed, the winding speed VF will decrease along with the reduction of the traversing speed VC. When the traversing speed terminates, the winding speed VF drops by an amount DV to the circumferential speed VU of the package. However, since the traversing speed has been already reduced considerably, the jump of the yarn slackening is relatively small and, consequently, in many cases acceptable for the winding method.

With reference to FIGS. 8 and 8A, a method is described, in which the circumferential speed VU of the package is increased at a rate which is proportional to the decrease of the traversing speed VC, and in such a manner that the winding speed VF remains substantially constant. This variation of the circumferential speed of the package is possible only when the decrease of the traversing speed is time-dependent, i.e., occurs slowly and steadily, because of the large mass of the package and winding spindle. It is not possible to suddenly increase the circumferential speed of the package when the traversing motion discontinues. However, this is not needed in the method of the present invention, since the difference DV, by which the winding speed VF decreases when the traversing motion terminates after a meanwhile increased circumferential speed, is only very small. For example, when the traversing speed is decreased before the traversing motion stops to an extent that the crossing angle is only 3°, and when simultaneously the circumferential speed is increased so that the yarn winding speed remains substantially constant, the loss DV of the yarn winding speed is only very small, i.e., 0.14%, at the moment in which the traversing motion stops. This means that only a very slight slackening of the yarn will occur.

In the method of FIGS. 9 and 9A, which corresponds in its phases I, II, VII to that of FIGS. 8 and 8A, the circumferential speed is so much increased while the traversing speed is reduced in operating phase III, that the winding speed increases. In the illustrated embodiment, the circumferential speed is increased up to the value of the nominal winding speed. As a result, the actual value of the winding speed increases above its nominal value. This means, on the other hand, that during the package doffing phase in which the traversing motion discontinues during the operating phase V, the actual value of the winding speed is close to its nominal value, i.e, the same as its nominal value in the illustrated embodiment. However, also in this method a decrease DV of the winding speed is unavoidable when the traversing motion discontinues in operating phase V. Yet, this decrease is not greater than in the method of FIGS. 8 and 8A, and otherwise moves on a high yarn tension level, so that there is no need to fear a sagging of the yarn, which might lead to an interruption of the winding process.

FIG. 7 also illustrates in dashed lines the course of the spacing A between the yarn traversing system and the package during the package doffing phases. It should be noted that the same course may also apply to the methods of FIGS. 8 and 9. The spacing A is here defined to be equal to the trailing length L1 between the guide roll 21 and the package 8.1. The situation is such that with regard to the law under which the yarn is deposited on the package, the guide roll 21 is to be added to the yarn traversing system. The yarn is deposited on the package in the same manner as the traversing yarn guide 3 deposits it on the guide roll 21.

As aforesaid, at the start of phase III the carriage 22 moves upwardly, and thus the spacing A between the guide roll and the package is increased. This procedure may first be carried out concurrently with the considerable reduction of the traversing speed which occurs in the phase III. The end of this enlargement of the spacing follows the end of phase III. Thereafter, the spacing A remains constant for a while. After the traversing speed is entirely discontinued in phase V, after the package is doffed and after the new spindle is brought to its operating position, the traversing speed is restored in phase II. At the same time, however, the carriage is again lowered, and as a result thereof the spacing between the guide roll and the new package is again decreased. Preferably, the carriage is again moved to its operating position, and the guide roll is again brought into contact with the package, before the phase VII starts with the increase of the traversing speed. As a result of this decrease of the spacing the traversing stroke, the length at which the yarn is deposited on the package is increased, so that a basic layer is wound on the package, which has a greater length than the remainder of the package. This decrease of the spacing occurs preferably after the traversing speed is restored, i.e. after the completion of phase V. Both the decrease of the spacing A and the increase of the traverse speed contribute to building up a conical basic layer.

In the drawings and specification, there has been set forth a preferred embodiment of the invention, and although specific terms are employed, they are used in a generic and descriptive sense only and not for purposes of limitation.

That which is claimed is:

1. A method for continuously winding a high speed running yarn or the like onto bobbins serially delivered to a winding position, and without yarn stoppage between bobbin changes, and comprising the steps of, (a) winding the running yarn onto a rotating first bobbin positioned at the winding position while gradually reducing the rotational speed of the bobbin, and including traversing the yarn at a location upstream of the winding position to thereby form a cross-wound package on the first bobbin, (b) laterally separating the rotating first bobbin from said winding position upon the bobbin becoming full, and such that the length of the running yarn between the traversing location and the full bobbin increases, and while continuing to wind the yarn onto the rotating full bobbin, (c) bringing an empty rotating second bobbin into circumferential contact with the yarn running from said traversing location to the laterally separated full bobbin, (d) terminating the traverse of the running yarn and then (e) transferring the running yarn from the rotating full bobbin to the rotating second bobbin, and (f) decreasing the traversing speed during a period beginning shortly prior to the traverse being terminated in accordance with step (d), and with the rate of change of the decreasing traverse speed being greater than the rate of change of the decreasing rotational speed of the bobbin during the end portion of step (a).

2. A method for continuously winding a high speed running yarn or the like onto bobbins serially delivered to a winding position, and without yarn stoppage between bobbin changes, and comprising the steps of, (a) winding the running yarn onto a rotating first bobbin positioned at the winding position, and including traversing the yarn at a location upstream of the winding position to thereby form a cross-wound package on the first bobbin, (b) laterally separating the rotating first bobbin from said winding position upon the bobbin becoming full, and such that the length of the running yarn between the traversing location and the full bobbin increases, and while continuing to wind the yarn onto the rotating full bobbin, (c) bringing an empty rotating second bobbin into circumferential contact with the yarn running from said traversing location to the laterally separated full bobbin, (d) terminating the traverse of the running yarn and then (e) transferring the running yarn from the rotating full bobbin to the rotating second bobbin, and (f) decreasing the traversing speed during a period during step (b) and beginning substantially concurrently with step (b).

3. The method as defined in claim 1 or 2 wherein the step of decreasing the traversing speed includes continuously decreasing the traversing speed at a substantially uniform rate of change during the entirety of said period.

4. The method as defined in claim 1 or 2 comprising the further step of increasing the circumferential speed of the full first bobbin during the step of decreasing the traversing speed.

5. The method as defined in claim 4 wherein the step of increasing the circumferential speed includes increasing the circumferential speed sufficiently to cause the yarn winding speed to remain substantially constant.

6. The method as defined in claim 4 wherein the step of increasing the circumferential speed includes increasing the circumferential speed sufficiently to cause the yarn winding speed to slightly increase.

7. The method as defined in claim 4 wherein the step of increasing the circumferential speed includes increasing the circumferential speed sufficiently to cause the yarn winding speed to remain substantially unchanged from its speed during said winding step.

8. The method as defined in claim 1 or 2 wherein the step of decreasing the traversing speed includes decreasing the traversing speed sufficiently to cause the yarn winding speed to decrease by no more than about 0.5% when the traverse is terminated.

9. The method as defined in claim 1 or 2 comprising the further subsequent step of again traversing the yarn to form a cross wound package on the second bobbin.

10. The method as defined in claim 9 wherein the step of again traversing the yarn includes commencing such traversing at an initial speed substantially corresponding to the traversing speed just prior to said step of terminating the traverse.

11. The method as defined in claim 10 wherein the step of again traversing the yarn further includes increasing the traversing speed from said initial speed to a speed substantially corresponding to its speed during said winding step prior to producing 10% of the entire yarn thickness of the full package being produced.

12. The method as defined in claim 11 wherein the step of again traversing the yarn further includes decreasing the circumferential speed of the second bobbin while the traversing speed is increased, and so that the yarn winding speed remains substantially unchanged.

13. The method as defined in claim 1 or 2 wherein during the step of laterally separating the rotating first bobbin, the length of the running yarn between the traversing location and the full bobbin is such that the increased length compensates for the increased length of the yarn deposited on the full bobbin by reason of the decreasing traverse speed, and such that the deposited length of yarn is not greater than the length of the full bobbin.

14. The method as defined in claim 1 or 2 wherein the step of bringing an empty rotating second bobbin into circumferential contact with the yarn includes moving the second bobbin into the yarn path of travel so that the surface movement on the side of the rotating bobbin adjacent the yarn path of travel opposes the direction of yarn movement.

* * * * *

UNITED STATES PATENT AND TRADEMARK OFFICE

CERTIFICATE OF CORRECTION

PATENT NO. : 4,917,319

DATED : April 17, 1990

INVENTOR(S) : Erich Lenk

It is certified that error appears in the above-identified patent and that said Letters Patent is hereby corrected as shown below:

Column 1, line 31, "Yarn" should be -- yarn --

Column 4, line 46, "A" should be -- 1A --

Column 7, line 13, "Crossing" should be -- crossing --

Column 9, line 64, "II" should be -- VI --

Signed and Sealed this

Twelfth Day of May, 1992

*Attest:*

DOUGLAS B. COMER

*Attesting Officer*

*Acting Commissioner of Patents and Trademarks*